US005753586A

United States Patent [19]

Hamada et al.

[11] Patent Number: 5,753,586

[45] Date of Patent: May 19, 1998

[54] THERMAL SENSITIVE RECORDING SHEET

[75] Inventors: Kaoru Hamada; Yoshimi Midorikawa; Yutaka Wakita; Tomoaki Nagai; Akio Sekine; Hiroshi Ueda, all of Shinjuku-ku, Japan

[73] Assignee: Nippon Paper Industries Co., Ltd., Tokyo, Japan

[21] Appl. No.: 716,547

[22] Filed: Sep. 19, 1996

[30] Foreign Application Priority Data

Sep. 1, 1995 [JP] Japan ..... 7-240157

[51] Int. Cl.[6] ..... B41M 5/26

[52] U.S. Cl. ..... 503/209; 427/150; 503/208; 503/216; 503/225

[58] Field of Search ..... 427/150; 503/208, 503/209, 216, 225

[56] References Cited

PUBLICATIONS

Abstract of Jap. Laid–Open Publication No. 60–082382 (1985).
Abstract of Jap. Laid–Open Pat. Publication No. 57–201691 (1982).
Abstract of Jap. Laid–Open Pat. Publication No. 58–087094 (1983).
Abstract of Jap. Laid–Open Pat. Publication No. 7–304727 (1995).
Abstract of Jap. Laid–Open Pat. Publication No. 08–058242 (1996).
Abstract of Jap. Laid–Open Pat. Publication No. 08–238851 (1996).
Abstract of Jap. Laid–Open Pat. Publication No. 08–282117 (1996).
Abstract of Jap. Laid–Open Pat. Publication No. 08–282120 (1996).
Claim Translation of Jap. Pat. Laid–Open Publication No. 08–282121 (1996).
Claim Translation of Jap. Pat. Laid–Open Publication No. 08–282122 (1996).
Claim Translation of Jap. Pat. Laid–Open Publication No. 08–282123 (1996).
Claim Translation of Jap. Pat. Laid–Open Publication No. 08–290672 (1996).
U.S. Patent Application Serial No. 08/504,784.
U.S. Patent Application Serial No. 08/549,240.

*Primary Examiner*—Bruce H. Hess
*Attorney, Agent, or Firm*—Sherman and Shalloway

[57] ABSTRACT

A thermal sensitive recording sheet comprising a substrate having thereon a thermal sensitive color developing layer mainly composed of basic leuco dye and an organic color developer, characterized by said thermal sensitive developing layer includes derivatives of amino benzene sulfone amide indicated by general formula (I) as an organic color developer, and includes sulfone amide compound indicated by general formula (II) as a sensitizer by amount of 0.01–2 parts based on 1 part of the color developer indicated by general formula (I).

(I)

wherein "X" indicates an oxygen or sulfur atom, "Y" indicates a lower alkyl group of carbon number 1–4 or electron attracting group and "m" indicates an integral number from 0 to 4. "R" indicates a non-substituted or a substituted phenyl group, aralkyl group, lower alkyl group of carbon number 1–6, cycloalkyl group of carbon number 3–6, lower alkenyl group of carbon number 2–6 or naphthyl group.

(II)

wherein "Z" indicates a lower alkyl group of carbon number 1–6 or electron attracting group. "n" indicates an integral number from 0 to 2.

1 Claim, No Drawings

THERMAL SENSITIVE RECORDING SHEET

BACK GROUND OF THE INVENTION

This invention relates to a thermal sensitive recording sheet which superiors in color developing sensitivity.

DISCLOSURE OF THE PRIOR ART

Generally, a thermal sensitive recording sheet is obtained by following method. A colorless or pale colored basic leuco dye and an organic developer such as phenolic compound or the like are separately ground into fine particles and dispersed, then mixed together. A binder, a filler, a sensitizer, a lubricant and other auxiliaries are added to prepare surface coating color, and is coated on a substrate such as paper, synthetic paper, film or plastics, which develops a color by an instantaneous chemical reaction caused by heating with a thermal sensitive head, a hot stamp, a thermal pen, a laser beam or the like to obtain a recording image. These thermal sensitive recording substance are widely applied to measuring recorders, terminal printers of computer, facsimiles, automatic ticket venders, bar cord labels and the likes. Recently, along with the improvement of these recording equipments to have multiple functions and to perform a higher quality, a technique for the high speed printing and high speed color image performing are becoming possible, and higher quality level is required for the recording sensitivity of thermal sensitive recording substance.

To meet the above mentioned requirements, a method to use a sensitizer in addition with a dye and a color developer has been proposed. For instance, in the case that the color developer comprising phenolic compounds represented by bisphenol A, p-benzyl biphenyl (Japanese Patent Laid-open Publication S60-82382), p-benzyl oxybenzyl-benzoate (Japanese Laid-open Publication S57-201691), benzylnaphtyl ether (Japanese Patent Laid-open Publication S58-87094) are used as adequate sensitizers. At the actual use, the sensitizer must be molten by heating at first, then the molten sensitizer dissolve a dye and a color developer in it, so as to these chemicals are mixed mutually in molecule level and the color developing reaction is caused. Therefore, the selection of a sensitizer to be used and a dye and a color developer becomes very important.

On the other hand, the inventors of this invention have already proposed the thermal recording substance which uses derivatives of amino benzene sulfone amide including amino sulfonyl group ($—SO_2NH_2$) as the color developer in Japanese Patent Laid-open Publication H6-100082, Japanese Patent Laid-open Publication H6-168516 and Japanese Patent Laid-open Publication H6-195568. However, these compounds have a good color developing sensitivity when impressed energy is high, but a sufficient color density can not be obtained when the impressed energy is low or when printing speed is high. Consequently, it seems that the said thermal recording substance is not sufficient for the practical application to such kinds of equipment.

OBJECT OF THE INVENTION

This invention relates to a thermal sensitive recording substance using amino benzene sulfone amide as the color developer, and the object of this invention is to provide the thermal sensitive recording substance of which color sensitivity is remarkably improved.

DETAILED DESCRIPTION OF THE INVENTION

The inventors have conduced intensive studies to develop a thermal sensitive recording substance having above mentioned features, and consequently accomplished the present invention. Namely, the inventors succeeded to improve the recording sensitivity remarkably by using derivatives of amino benzene sulfone amide as a color developer and in addition with it to use aromatic compounds including amino sulfonyl group ($—SO_2NH_2$) as a sensitizer. That is, this invention relates to a thermal sensitive recording sheet comprising a substrate having thereon a thermal sensitive color developing layer mainly composed of a colorless or pale colored basic leuco dye and an organic color developer, characterized by said thermal sensitive developing layer includes derivatives of amino benzene sulfone amide indicated by following general formula (I) as an organic color developer, and includes sulfone amide compound indicated by following general formula (II) as a sensitizer by amount of 0.01–2 parts based on 1 part of color developer indicated by general formula (I).

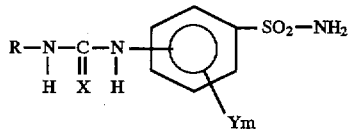

(I)

(in this formula, "X" indicates an oxygen or sulfur atom, "Y" indicates a lower alkyl group of carbon number 1–4 or electron attracting group and "m" indicates an integral number from 0 to 4. "R" indicates a non-substituted or a substituted phenyl group, aralkyl group, lower alkyl group of carbon number 1–6, cycloalkyl group of carbon number 3–6, lower alkenyl group of carbon number 2–6 or naphthyl group)

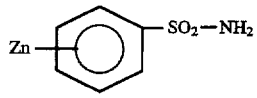

(II)

(in this formula, "Z" indicates a lower alkyl group of carbon number 1–6 or electron attracting group. "n" indicates an integral number from 0 to 2)

In the present invention, at least one type of derivatives of amino benzene sulfone amide indicated by general formula (I) is used as an organic color developer. In the general formula (I), "X" indicates an oxygen or sulfur atom and "Y" indicates a substitution group which does not affect the color developing ability. And as the said substitution group, following groups can be mentioned, for instance a lower alkyl group of carbon number 1–6 such as methyl group or ethyl group or an electron attracting group such as chloride atom, nitro group, methoxy group. "R" indicates hydrocarbon groups, and concretely phenyl group, aralkyl group, lower alkyl group of carbon number 1–6, cycloalkyl group of carbon number 3–6, lower alkenyl group of carbon number 2–6 or naphthyl group. In "R", it is possible to introduce a substitution group which does not hurt the color developing ability and the following groups can be mentioned, for instance lower alkyl group of carbon number 1–6 such as methyl group or ethyl group, or electron attracting group such as chloride atom, nitro group, methoxy group. The compounds of general formula (I) are concretely mentioned as from (I-1) to (I-72), however, these are not intended to give a limitation to this invention. From the view point that the raw materials can be easily obtained and also that the synthetic method of it is easy, (I-10) is preferably used. Further, in this invention, for the purpose to improve the sensitivity, it is possible to use the well-known color developer by amount of 0.01–0.9 parts based on 1 part of the compound indicated by following general formula (I).

(I-1)
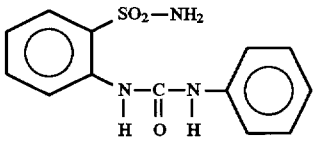
(I-2)
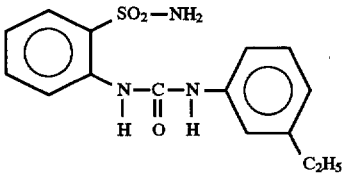
(I-3)
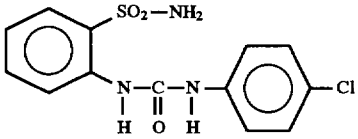
(I-4)
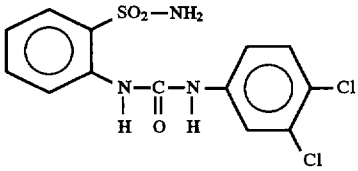
(I-5)
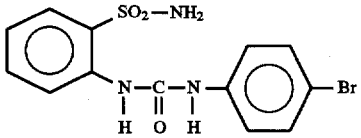
(I-6)
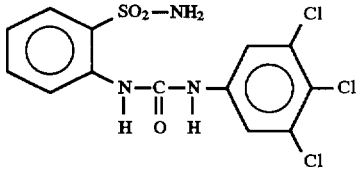
(I-7)
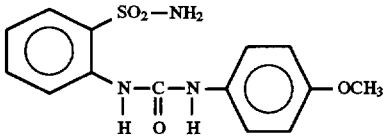
(I-8)
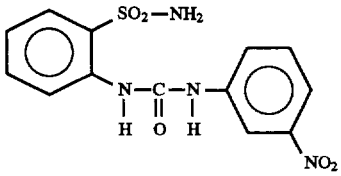
(I-9)
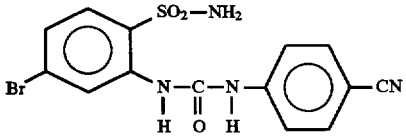
(I-10)
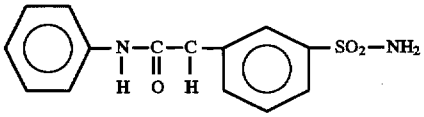
-continued
(I-11)
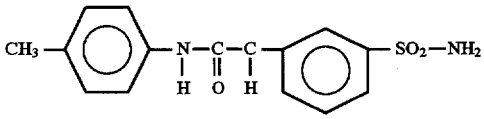
(I-12)
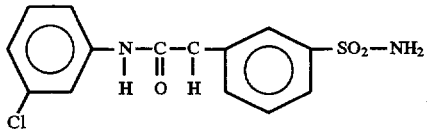
(I-13)
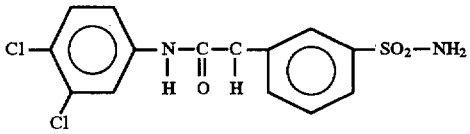
(I-14)
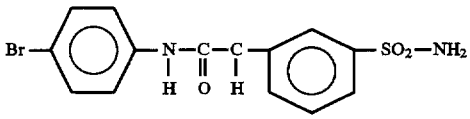
(I-15)
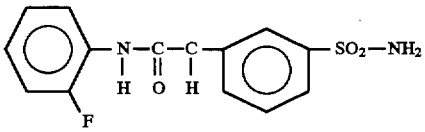
(I-16)
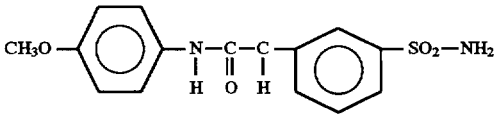
(I-17)
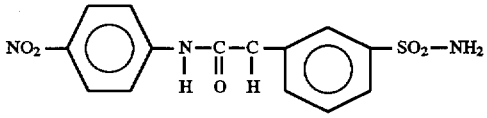
(I-18)
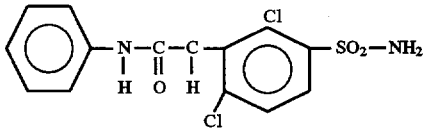
(I-19)
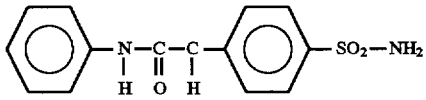
(I-20)
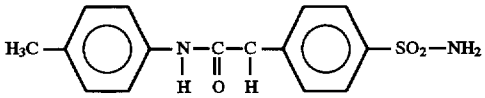
(I-21)
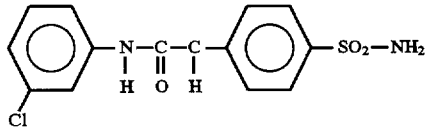
(I-22)
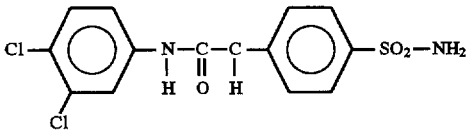

-continued
(I-23)
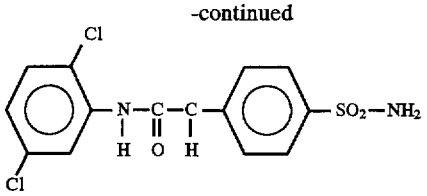
(I-24)
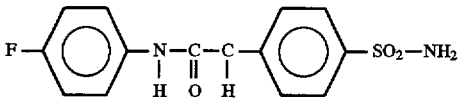
(I-25)
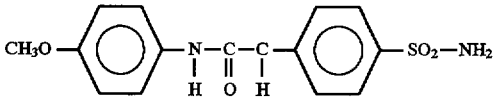
(I-26)
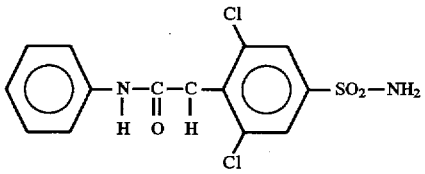
(I-27)
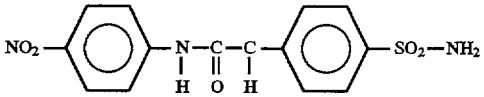
(I-28)
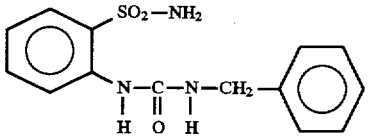
(I-29)
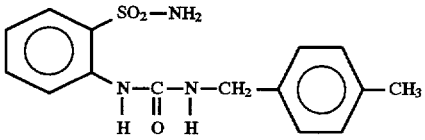
(I-30)
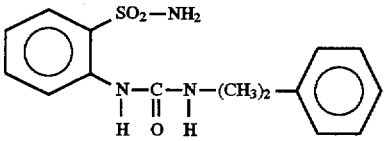
(I-31)
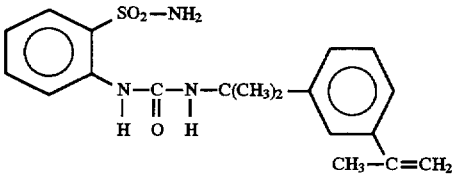
(I-32)
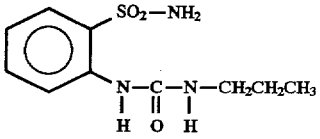
(I-33)
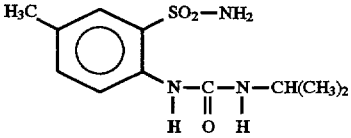
-continued
(I-34)
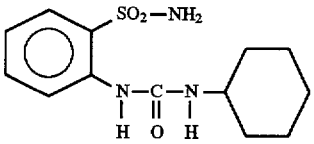
(I-35)
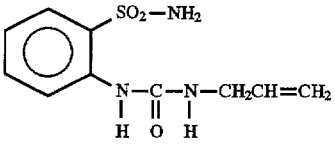
(I-36)
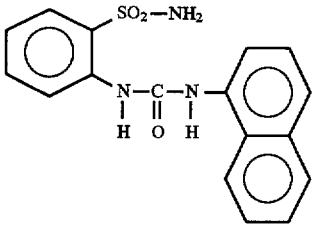
(I-37)
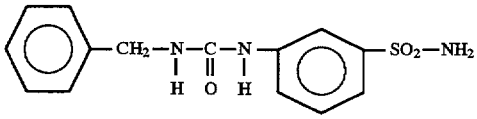
(I-38)
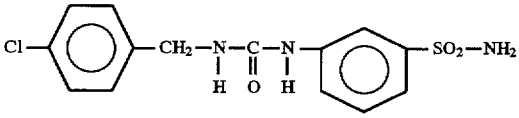
(I-39)
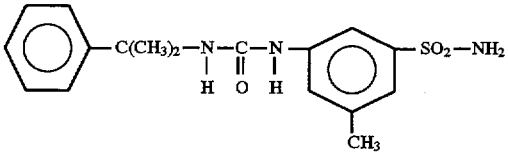
(I-40)
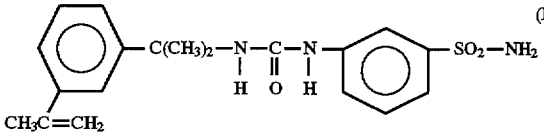
(I-41)
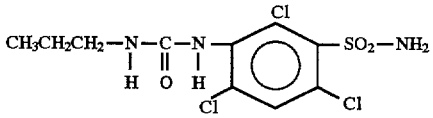
(I-42)
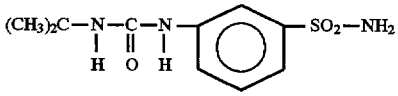
(I-43)
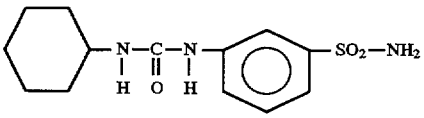
(I-44)
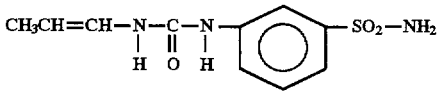

-continued
(I-45)
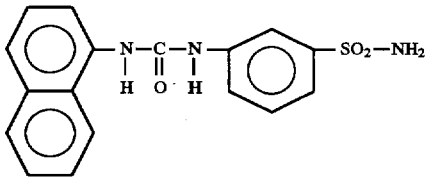
(I-46)
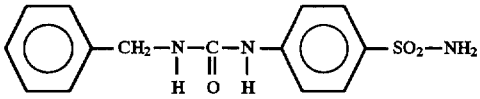
(I-47)
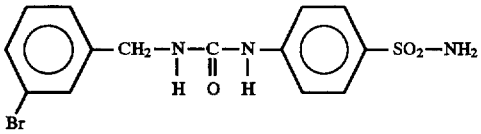
(I-48)
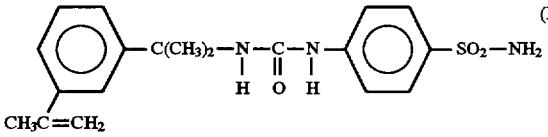
(I-49)
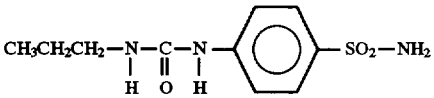
(I-50)
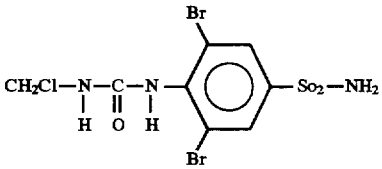
(I-51)
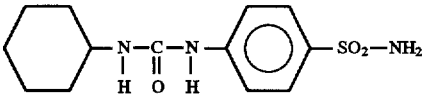
(I-52)
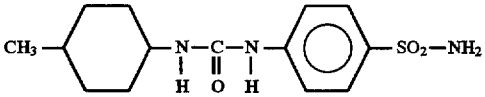
(I-53)
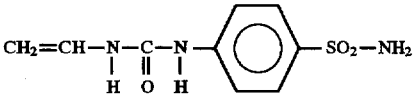
(I-54)
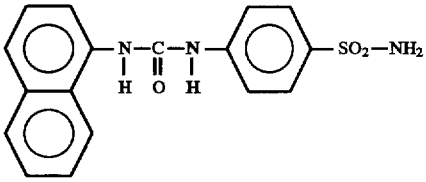
(I-55)
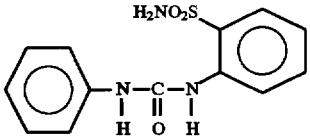
-continued
(I-56)
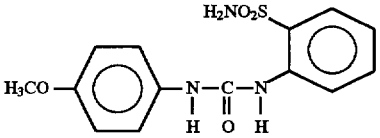
(I-57)
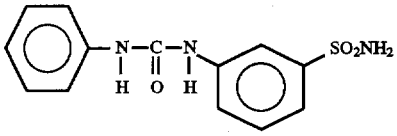
(I-58)
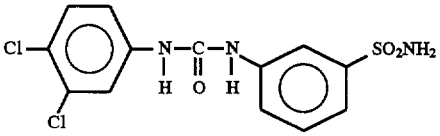
(I-59)
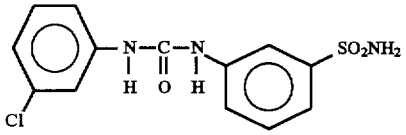
(I-60)
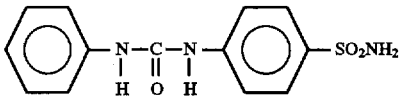
(I-61)
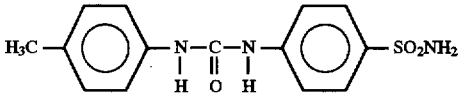
(I-62)
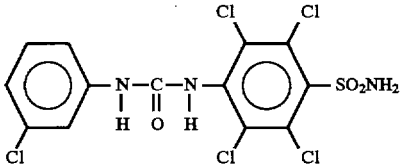
(I-63)
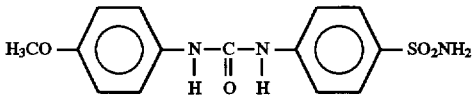
(I-64)
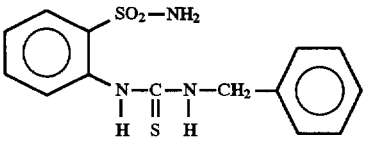
(I-65)
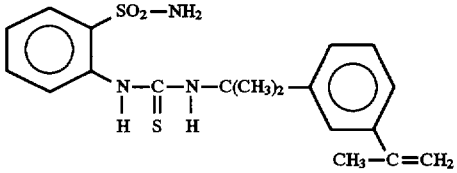
(I-66)
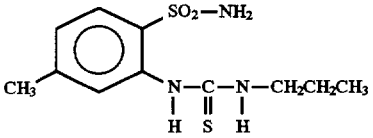

-continued (I-67)

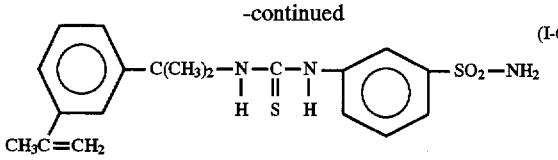

(I-68)

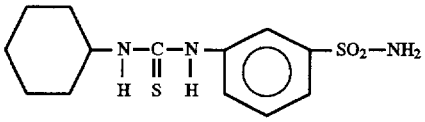

(I-69)

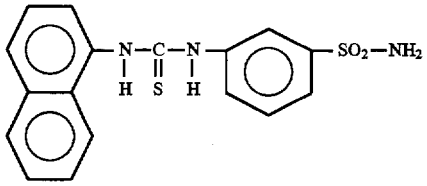

(I-70)

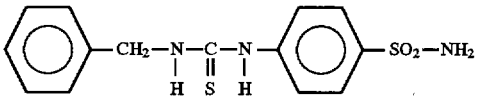

(I-71)

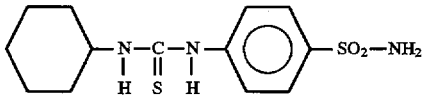

(I-72)

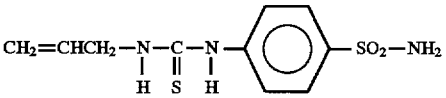

And also in the present invention, at, least one type of sulfone amide compounds indicated by general formula (II) is used as the sensitizer. In general formula (II), "Z" is a substitution group which does not hurt the sensitizing effect, and lower alkyl group of carbon number 1–6 such as methyl group or ethyl group, or electron attracting group such as chloride atom, nitro group and methoxy group can be mentioned as the concrete example, however, these are not intended to give a limitation to the present invention. The compounds of general formula (II) are concretely indicated from (II-1) to (II-30), but not limited to them. From the view point that the effect caused by using together with above mentioned developer (I-10) is excellent, (II-2) or (II-4) is preferably used.

(II-1)

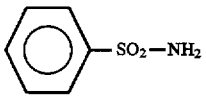

(II-2)

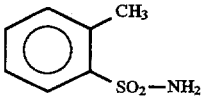

(II-3)

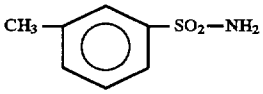

(II-4)

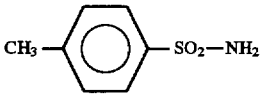

-continued (II-5)

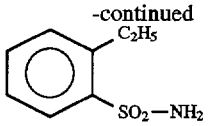

(II-6)

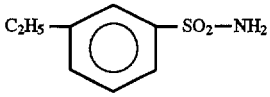

(II-7)

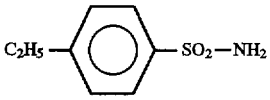

(II-8)

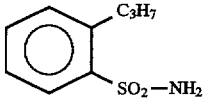

(II-9)

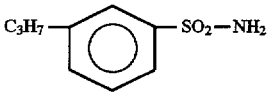

(II-10)

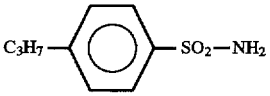

(II-11)

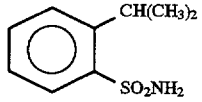

(II-12)

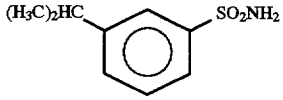

(II-13)

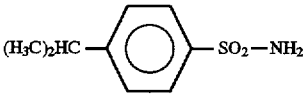

(II-14)

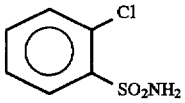

(II-15)

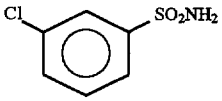

(II-16)

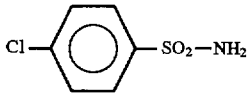

(II-17)

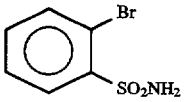

(II-18)

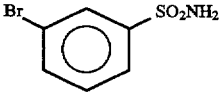

(II-19)

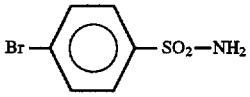

-continued (II-20)

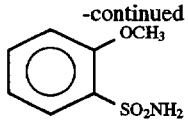

(II-21)

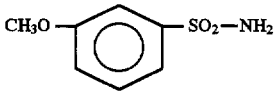

(II-22)

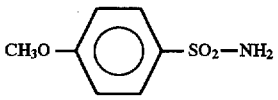

(II-23)

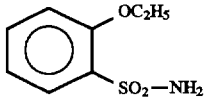

(II-24)

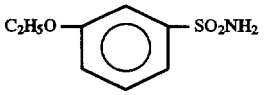

(II-25)

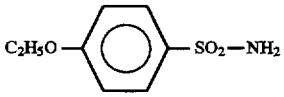

(II-26)

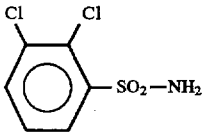

(II-27)

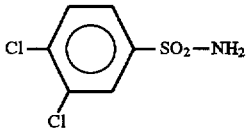

(II-28)

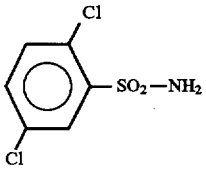

(II-29)

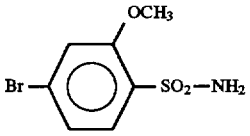

(II-30)

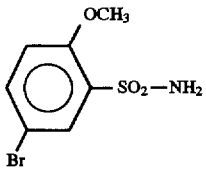

In this invention, the sensitizing effect is not sufficient when the amount of content of the sensitizer indicated by general formula (II) is smaller than 0.01 parts based on 1 part of the developer of general formula (I), and when it exceeds 2 parts based on 1 part of the developer, the sufficient color developing density can not be obtained. Therefore, the desirable amount of the sensitizer indicated by general formula (II) is between 0.01 and 2 parts based on 1 part of the developer.

Generally, the thermal sensitive recording substance is prepared by following process. That is, prepare the coating color by dispersing a normal dye and a developer with a binder, add additives such as sensitizer, filler, U. V. absorbent, water proof chemical, deformer and others in accordance with a quality requirement, then coat the prepared coating color on the surface of substrate and dry up it. Every conventional pressure sensitive type dyes or every well-known dyes in the field of thermal sensitive recording paper can be used as the dye of the thermo sensitive recording substance of this invention, and is not specifically limited, but preferably triphenylmethan-based compounds, fluoran-based compounds and divinyl-based compounds are mentioned. The concrete examples of the typical dye are mentioned as follows. These dyes can be used alone, or in combination with more than two.

<triphenylmethane-based leuco dyes>

3,3-bis(p-dimethylaminophenyl)-6-dimethylaminophthalide [another name is crystal violet lactone]

3,3-bis(p-dimethylaminophenyl)phthalide [another name is malachite green lactone]

<fluoran-based leuco dyes>

3-diethylamino-6-methylfluoran 3-diethylamino-6-methyl-7-anilinofluoran 3-diethylamino-6-methyl-7-(o,p-dimethylanilino)fluoran 3-diethylamino-6-methyl-7-chlorofluoran 3-diethylamino-6-methyl-7-(m-trifluoromethylanilino)fluoran 3-diethylamino-6-methyl-7-(o-chloroanilino)fluoran 3-diethylamino-6-methyl-7-(p-chloroanilino)fluoran 3-diethylamino-6-methyl-7-(o-fluoroanilino)fluoran 3-diethylamino-6-methyl-7-n-octylanilinofluoran 3-diethylamino-6-methyl-7-n-octylaminofluoran 3-diethylamino-6-methyl-7-benzylanilinofluoran 3-diethylamino-6-methyl-7-dibenzylanilinofluoran 3-diethylamino-6-chloro-7-methylfluoran 3-diethylamino-6-chloro-7-anilinofluoran 3-diethylamino-6-chloro-7-p-methylanilinofluoran 3-diethylamino-6-ethoxyethyl-7-anilinofluoran 3-diethylamino-7-methylfluoran 3-diethylamino-7-chlorofluoran 3-diethylamino-7-(m-trifluoromethylanilino)fluoran 3-diethylamino-7-(o-chloroanilino)fluoran 3-diethylamino-7-(p-chloroanilino)fluoran 3-diethylamino-7-(o-fluoroanilino)fluoran 3-diethylamino-benzo[a]fluoran 3-diethylamino-benzo[c]fluoran 3-dibutylamino-6-methyl-fluoran 3-dibutylamino-6-methyl-7-anilinofluoran 3-dibutylamino-6-methyl-7-(o,p-dimethylanilino)fluoran 3-dibutylamino-6-methyl-7-(o-chloroanilino)fluoran 3-dibutylamino-6-methyl-7-(p-chloroanilino)fluoran 3-dibutylamino-6-methyl-7-(o-fluoroanilino)fluoran 3-dibutylamino-6-methyl-7-(m-trifluoromethylanilino)fluoran 3-dibutylamino-6-methyl-chlorofluoran 3-dibutylamino-6-ethoxyethyl-7-anilinofluoran 3-dibutylamino-6-chloro-7-anilinofluoran 3-dibutylamino-6-methyl-7-p-methylanilinofluoran 3-dibutylamino-7-(o-chloroanilino)fluoran
3-dibutylamino-7-(o-fluoroanilino)fluoran
3-n-dipentylamino-6-methyl-7-anilinofluoran
3-n-dipentylamino-6-methyl-7-(p-chloroanilino)fluoran
3-n-dipentylamino-7-(m-trifluoromethylanilino)fluoran
3-n-dipentylamino-6-chloro-7-anilinofluoran
3-n-dipentylamino-7-(p-chloroanilino)fluoran
3-pyrrolidino-6-methyl-7-anilinofluoran
3-piperidino-6-methyl-7-anilinofluoran
3-(N-methyl-N-propylamino)-6-methyl-7-anilinofluoran
3-(N-methyl-N-cyclohexylamino)-6-methyl-7-anilinofluoran
3-(N-ethyl-N-cyclohexylamino)-6-methyl-7-anilinofluoran
3-(N-ethyl-N-xylamino)-6-methyl-7-(p-chloroanilino) fluoran
3-(N-ethyl-p-toluidino)-6-methyl-7-anilinofluoran
3-(N-ethyl-N-isoamylamino)-6-methyl-7-anilinofluoran
3-(N-ethyl-N-isoamylamino)-6-chloro-7-anilinofluoran
3-(N-ethyl-N-tetrahydrofurfurylamino)-6-methyl-7-anilinofluoran
3-(N-ethyl-N-isobutylamino)-6-methyl-7-anilinofluoran
3-(N-ethyl-N-ethoxypropylamino)-6-methyl-7-anilinofluoran
3-cyclohexylamino-6-chlorofluoran
2-(4-oxahexyl)-3-dimethylamino-6-methyl-7-anilinofluoran
2-(4-oxahexyl)-3-diethylamino-6-methyl-7-anilinofluoran
2-(4-oxahexyl)-3-dipropylamino-6-methyl-7-anilinofluoran
2-methyl-6-p-(p-dimethylaminophenyl) aminoanilinofluoran
2-methoxy-6-p-(p-dimethylaminophenyl) aminoanilinofluoran
2-chloro-3-methyl-6-p-(p-phenylaminophenyl) aminoanilinofluoran
2-chloro-6-p-(p-dimethylaminophenyl) aminoanilinofluoran
2-nitro-6-p-(p-diethylaminophenyl)aminoanilinofluoran
2-amino-6-p-(p-diethylaminophenyl)aminoanilinofluoran
2-diethylamino-6-p-(p-diethylaminophenyl) aminoanilinofluoran
2-phenyl-6-methyl-6-p-(p-phenylaminophenyl) aminoanilinofluoran
2-benzyl-6-p-(p-phenylaminophenyl) aminoanilinofluoran
2-hydroxy-6-p-(p-phenylaminophenyl) aminoanilinofluoran
3-methyl-6-p-(p-dimethylaminophenyl) aminoanilinofluoran
3-diethylamino-6-p-(p-diethylaminophenyl) aminoanilinofluoran
3-diethylamino-6-p-(p-dibutylaminophenyl) aminoanilinofluoran
2,4-dimethyl-6-[(4-dimethylamino)anilino]-fluoran
<fluorene-based leuco dyes>
3,6,6'-tris(dimethylamino)spiro[fluorene-9,3'-phthalide]
3,6,6'-tris(diethylamino)spiro[fluorene-9,3'-phthalide]
<divinyl-based leuco dyes>
3,3-bis-[2-(p-dimethylaminophenyl)-2-(p-methoxyphenyl) ethenyl]-4,5,6,7-tetrabromophthalide
3,3-bis-[2-(p-dimethylaminophenyl)-2-(p-methoxyphenyl) ethenyl]-4,5,6,7-tetrachlorophthalide
3,3-bis-[1,1-bis(4-pyrrolidinophenyl)ethylene-2-yl]-4,5,6, 7-tetrabromophthalide
3,3-bis-[1-(4-methoxyphenyl)-1-(4-pyrrolidinophenyl) ethylene-2-yl]-4,5,6,7-tetrachlorophthalide
<others>
3-(4-diethylamino-2-ethoxyphenyl)-3-(1-ethyl-2-methylindole- 3-yl)-4-azaphthalide
3-(4-diethylamino-2-ethoxyphenyl)-3-(1-octyl-2-methylindole-3-yl)-4-azaphthalide
3-(4-cyclohexylethylamino-2-methoxyphenyl)-3-(1-ethyl-2-methylindole-3-yl)-4-azaphthalide
3,3-bis(1-ethyl-2-methylindole-3-yl)phthalide
3,6-bis(diethylamino)fluoran-γ-(3'-nitro)anilinolactam
3,6-bis(diethylamino)fluoran-γ-(4'-nitro)anilinolactam
1,1-bis-[2',2',2",2"-tetrakis-(p-dimethylaminophenyl)-ethenyl]-2,2-dinitrylethane
1,1-bis-[2',2',2",2"-tetrakis-(p-dimethylaminophenyl)-ethenyl]-2-β-naphthoylethane
1,1-bis-[2',2',2",2"-tetrakis-(p-dimethylaminophenyl)-ethenyl]-2,2-diacetylethane
bis-[2,2,2',2'-tetrakis-(p-dimethylaminophenyl)-ethenyl]-methylmalonatedimethylester In this invention, it is possible to add conventional well-known sensitizer within a limit in so far as not hurting the expected effect of this invention. And as the examples of said sensitizer, fatty acid amide such as amide stearate and amide palmitate, ethylene bis-amide, montanic acid wax, polyethylene wax, 1,2-di-(3-methylphenoxy)ethane, p-benzylphenyl, β-benzyloxynaphthalene, 4-biphenyl-p-tolylether, m-terphenyl, 1,2-diphenoxyethane, dibenzyl oxalate, di(p-chlorobenzyl)oxalate, di(p-methylbenzyl) oxalate, dibenzyl terephthalate, benzyl p-benzyloxy benzoic acid, di-p-tolylcarbonate, phenyl-α-naphthylcarbonate, 1,4-diethoxynaphthalene, 1-hydroxy-2-naphthoic acid phenyl ester, o-xylylene-bis-(phenylether) and 4-(m-methylphenoxy -methyl)biphenyl can be illustrated, but is not specifically limited to them. These sensitizers can be used alone, or in combination with more than two.

As the binder used in the present invention, full saponificated polyvinyl alcohol of 200–1900 polimerization degree, partial saponificated polyvinyl alcohol, denatured polyvinyl alcohol such as denatured polyvinyl alcohol by carboxy, denatured polyvinyl alcohol by amide, denatured polyvinyl alcohol by sulfonic acid and denatured polyvinyl alcohol by butyral, derivatives of cellulose such as hydroxyethyl cellulose, methyl cellulose, ethyl cellulose, carboxymethyl cellulose and acetyl cellulose, copolymer of styrene-maleic anhydride, copolymer of styrene-butadiene, poly vinylchloride, polyvinylacetate, polyacrylicamide, polyacrylicester, polyvinylbutyral, polystyrene or copolymer of them, polyamide resin, silicon resin, petroleum resin, terpene resin, ketone resin, and cumarone resin can be illustrated. These macromolecule compounds can be applied by being dissolved into solvent such as water, alcohol, ketone, ester or hydrocarbon or by being dispersed in water or other medium under an emulsion state or a paste state, and these forms of application can be used in combination according to the quality requirement.

In this invention, it is possible to add metallic salts (Ca, Zn) of p-nitrobenzoic acid or metallic salts (Ca, Zn) of phtalic acid monobenzyl ester which is a well-known stabilizer showing a good effect for oil resistance of the recorded image, within a limit in so far as not hurting the expected effect of the present invention.

As a filler which can be use in this invention, following inorganic or organic compounds can be mentioned. Namely, silica, calcium carbonate, kaoline, calcined kaoline, diatomaceous earth, talc, titanium oxide, zinc oxide, aluminium hydoxide, polystyrene resin, urea-formalin resin, styrene-methacrylilate copolymer, styrene-butadien copolymer or hollow plastic pigment.

Furthermore, a parting compound such as metallic salt of fatty acid, a lubricant such as wax, an U.V. absorbent such as benzophenone-based or triazole-based, a water proof chemical such as glyoxal, a dispersing agent, a deformer, an antioxidant and a fluorescent dye can be used as the additives.

The amount of developer and dye, and the types and amounts of other compounds to be used in this invention are determined according to the required features and recording property of the thermo sensitive recording sheet, and generally, desirable amount of these compounds are follows, but are not specifically limited. That is, 0.1–2 parts of dye, 0.01–2 parts of sensitizer indicated by general formula (II) and 0.5–4 parts of filler are the desirable amount based on 1 part of developer indicated by general formula (I), and also the desirable amount of binder is 5–25% to the total amount of a solid.

As a substrate, paper, synthetic paper, plastic film, non-woven cloth and metallic foil or the hybrid sheet composed by said substances can be used. A voluntary substrate is selected from above mentioned substrates, and the coating color of above mentioned composition is coated over the surface of the substrate and the objected thermo sensitive recording substance can be obtained. Furthermore, for the purpose to improve the preserving durability, it is possible to prepare an over coating layer including macromolecule substances on the thermo sensitive color developing layer. Still further, for the purpose to improve the preserving durability and sensitivity, it is possible to prepare an under coating layer including an organic or inorganic filler between the color developing layer and the substrate.

EXAMPLES OF THE INVENTION

The thermo sensitive recording substance of this invention can be obtained by following procedure. That is, prepare the coating color of thermo sensitive color developing layer by dispersing colorless basic leuco dye, one or more types of amino benzene sulfone amide derivatives indicated by said general formula (I) as a developer and one or more types of sulfone amide compounds indicated by said general formula (II) as a sensitizer with a binder, then add a filler and other additives in accordance with a quality requirement, coat this coating color on the substrate and dry up it. Sulfone amide compounds indicated by general formula (II) is used by the amount ratio of 0.01–2 parts based on 1 part of the developer indicated by general formula (I).

Generally, the developer which includes an acidic functional group such as phenolic hydroxyl group or carboxyl group is possessed of a higher color developing ability. Although derivatives of amino benzene sulfone amide indicated by general formula (I) in this invention do not include these functional groups, display strong developing ability toward the basic dye. And the reason of said phenomenon is not clearly elucidated, but presumed as follows. Namely, amino benzene sulfone amide derivatives of this invention, are thought to cause structural transformation (tautomerism) from neutral structure to acidic structure as shown by general formula below under the specific condition, and function as a developer when form the acidic structure. The high temperature condition is needed to cause tautomerism from neutral to acidic structure. In the case of thermal sensitive recording, the temperature of thermal head rises instantly to 200°–300° C., so the compound indicated by formula (I) included in the recording layer of thermal sensitive recording substance causes tautomerism to acidic structure, and consequently the developing ability is realized. And accordingly, it is guessed that the lactone ring of dye is bursted and develops color.

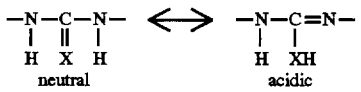

(in this formula, "X" indicates an oxygen or sulfur atom) Further, the sensitizer indicated by formula (II) used in this invention have a function which cause a structural transformation from neutral to acidic structure for the developer when it is molten together with the developer indicated by formula (I).

EXAMPLES

<Preparation of Thermal Sensitive Recording Substance>

The present invention is further illustrated by following examples. In the examples and comparative examples, the term of "parts" and "%" means "parts by weight" and "weight %", unless special provision.

EXAMPLE 1–5

From Example 1 to 5 are the experimental results which use compound (I-1), (I-10), (I-13), (I-19) or (I-26) as a developer, 3-diethylamino-6-methyl-7-anilinofluoran (ODB) as a dye and compound (II-4) as a sensitizer. The dispersion of color developer (solution A), the dispersion of dye (solution B) and dispersion of sensitizer (solution C) are ground separately to average particle diameter of 1 μm with a sand grinder.

| Solution A (dispersion of color developer) | |
|---|---|
| color developer | 6.0 parts |
| 10% polyvinyl alcohol water solution | 18.8 parts |
| water | 11.2 parts |

| Solution B (dispersion of dye) | |
|---|---|
| 3-diethylamino-6-methyl-7-anilinofluoran(ODB) | 2.0 parts |
| 10% polyvinyl alcohol water solution | 4.6 parts |
| water | 2.6 parts |

| Solution C (dispersion of sensitizer) | |
|---|---|
| compound (II-4) | 4.0 parts |
| 10% polyvinyl alcohol water solution | 18.8 parts |
| water | 11.2 parts |

Then, the resulting dispersions are mixed together in the proportion below so as to prepare the coating color.

| | |
|---|---|
| Solution A (dispersion of color developer) | 36.0 parts |
| Solution B (dispersion of dye[ODB]) | 9.2 parts |
| Solution C (dispersion of sensitizer [compound(II-4)]) | 34.0 parts |
| Kaoline clay (50% dispersion) | 12.0 parts |

The prepared coating colors are applied to one side of 50 g/m$^2$ sheet substrate, then dried up and the sheet is processed by a super calender to surface smoothness of 500–600 second. Thus, the thermal sensitive recording sheet in a coating weight of 6.0 g/m$^2$ is obtained.

EXAMPLE 6–8

From Example 6 to 8 are the experimental results which use compound (I-10) as a developer, dyes indicated below excepting ODB as a dye and compound (II-4) as a sensitizer.

(dye)

ODB-2 ; 3-dibuthylamino-6-methyl-7-anilinofluoran

PSD-170 ; 3-pyrrolidino-6-methyl-7-anilinofluoran CVL; 3,3-bis(p-dimethylaminophenyl)-6-dimethylaminophthalide Dispersion of color developer of compound (I-10) and dispersion of sensitizer of compound (II-4) are treated by same procedure to Examples 1–5. Dispersion of dye (solution D) except ODB are ground separately to average particle diameter of 1 μm with a sand grinder.

| Solution D (dispersion of dye except ODB) | |
|---|---|
| above mentioned dye | 2.0 parts |
| 10% polyvinyl alcohol water solution | 4.6 parts |
| water | 2.6 parts |

Then, the resulting dispersions are mixed together in the proportion below so as to prepare the coating color.

| | |
|---|---|
| Solution A (dispersion of developer [compound (I-10)]) | 36.0 parts |
| Solution D (dispersion of dye except ODB) | 9.2 parts |
| Solution C (dispersion of sensitizer [compound (II-4)]) | 34.0 parts |
| Kaoline clay (50% dispersion) | 12.0 parts |

The prepared coating colors are applied to one side of 50 g/m$^2$ sheet substrate, then dried up and the sheet is processed by a super calender to surface smoothness of 500–600 second. Thus, the thermal sensitive recording sheet in a coating weight of 6.0 g/m$^2$ is obtained.

EXAMPLE 9

Example 9 is an experimental result which uses compound (I-10) as a developer, ODB as a dye and compound (II-2) as a sensitizer. Dispersion of compound (I-10) of color developer and dispersion of ODB are treated by same procedure to Examples 6–8. And compound (II-2) is treated likely to compound (II-4). Thus the solution E can be obtained.

Then, the resulting dispersions are mixed together in the proportion below so as to prepare the coating color.

| | |
|---|---|
| Solution A (dispersion of developer [compound (I-10)]) | 36.0 parts |

-continued

| | |
|---|---|
| Solution D (dispersion of dye [ODB]) | 9.2 parts |
| Solution E (dispersion of sensitizer [compound (II-2)]) | 34.0 parts |
| Kaoline clay (50% dispersion) | 12.0 parts |

The prepared coating colors are applied to one side of 50 g/m$^2$ sheet substrate, then dried up and the sheet is processed by a super calender to surface smoothness of 500–600 second. Thus, the thermal sensitive recording sheet in a coating weight of 6.0 g/m$^2$ is obtained.

EXAMPLE 10

Example 10 is an experimental result of which use compound (I-1) and (I-10) as a developer, ODB as a dye and compound (II-4) as a sensitizer. Dispersion of color developer of compound (I-1) and (I-10), dispersion of ODB, and dispersion of sensitizer of compound (II-4) are treated by same procedure to Examples 1–4.

Then, the resulting dispersions are mixed together in the proportion below so as to prepare the coating color.

| | |
|---|---|
| Solution A (dispersion of developer [compound (I-1)]) | 18.0 parts |
| Solution A (dispersion of developer [compound (I-10)]) | 18.0 parts |
| Solution B (dispersion of dye [ODB]) | 9.2 parts |
| Solution C (dispersion of sensitizer [compound (II-4)]) | 34.0 parts |
| Kaoline clay (50% dispersion) | 12.0 parts |

The prepared coating color is applied to one side of 50 g/m$^2$ sheet substrate, then dried up and the sheet is processed by a super calender to surface smoothness of 500–600 second. Thus, the thermal sensitive recording sheet in a coating weight of 6.0 g/m$^2$ is obtained.

EXAMPLE 11

Example 11 is an experimental result which use compound (I-10) as a developer, ODB and PSD-170 as a dye and compound (II-4) as a sensitizer. Dispersion of color developer of compound (I-10), dispersion of ODB and PSD-170, and dispersion of sensitizer of compound (II-4) are treated by same procedure to Examples 1–8.

Then, the resulting dispersions are mixed together in the proportion below so as to prepare the coating color.

| | |
|---|---|
| Solution A (dispersion of developer [compound (I-10)]) | 36.0 parts |
| Solution B (dispersion of dye [ODB]) | 4.6 parts |
| Solution D (dispersion of dye [PSD-170]) | 4.6 parts |
| Solution C (dispersion of sensitizer [compound (II-4)]) | 34.0 parts |
| Kaoline clay (50% dispersion) | 12.0 parts |

The prepared coating color is applied to one side of 50 g/m$^2$ sheet substrate, then dried up and the sheet is processed by a super calender to surface smoothness of 500–600 second. Thus, the thermal sensitive recording sheet in a coating weight of 6.0 g/m$^2$ is obtained.

EXAMPLE 12

Example 12 is an experimental result of which use compound (I-10) as a developer, ODB as a dye and compound (II-2) and (II-4) as a sensitizer. Dispersion of color developer of compound (I-10), dispersion of ODB, and dispersion of sensitizer of compound (II-2) and (II-4) are treated by same procedure to Examples 1–9.

Then, the resulting dispersions are mixed together in the proportion below so as to prepare the coating color.

| | |
|---|---|
| Solution A (dispersion of developer [compound (I-10)]) | 36.0 parts |
| Solution D (dispersion of dye [ODB]) | 9.2 parts |
| Solution C (dispersion of sensitizer [compound (II-4)]) | 17.0 parts |
| Solution E (dispersion of sensitizer [compound (II-2)]) | 17.0 parts |
| Kaoline clay (50% dispersion) | 12.0 parts |

The prepared coating color is applied to one side of 50 $g/m^2$ sheet substrate, then dried up and the sheet is processed by a super calender to surface smoothness of 500–600 second. Thus, the thermal sensitive recording sheet in a coating weight of 6.0 $g/m^2$ is obtained.

EXAMPLES 13–17

From Example 13 to 17 are the experimental results which use compound (I-1), (I-10) or (I-19) as a developer, compounds shown below as a dye and compound (II-2) or (II-4) as a sensitizer (described in table 1).

(dye)

S205;

3-(N-ethyl-N-isoamylamino)-6-methyl -7-anilinofluoran Black100;

3-diethylamino-7-(m-trifluoromethylanilino)fluoran

Dispersion of above mentioned dye (solution F) are ground separately to average particle diameter of 1 μm with a sand grinder. Dispersion of the developer and the sensitizer are treated by same procedure to Examples 1–10.

| Solution F (dispersion of dye) | |
|---|---|
| above mentioned dye precursor | 2.0 parts |
| 10% polyvinyl alcohol water solution | 4.6 parts |
| water | 2.6 parts |

Then, the resulting dispersions are mixed together in the proportion below so as to prepare the coating color.

| | |
|---|---|
| Solution A (dispersion of developer) | 36.0 parts |
| Solution F (dispersion of dye) | 9.2 parts |
| Solution C (dispersion of sensitizer) | 34.0 parts |
| Kaoline clay (50% dispersion) | 12.0 parts |

The prepared coating colors are applied to one side of 50 $g/m^2$ sheet substrate, then dried up and the sheet is processed by a super calender to surface smoothness of 500–600 second. Thus, the thermal sensitive recording sheet in a coating weight of 6.0 $g/m^2$ is obtained.

EXAMPLE 18

Example 18 is an experimental result which uses compound (I-10) as a developer, ODB and S205 as a dye and (II-4)as a , sensitizer. Dispersion of color developer of compound (I-10) dispersion of ODB and S205, and dispersion of sensitizer of compound (II-4) are treated by same procedure to Examples 1–17.

Then, the resulting dispersions are mixed together in the proportion below so as to prepare the coating color.

| | |
|---|---|
| Solution A (dispersion of developer [compound (I-10)]) | 36.0 parts |
| Solution B (dispersion of dye [ODB]) | 4.6 parts |
| Solution F (dispersion of dye [S205]) | 4.6 parts |
| Solution C (dispersion of sensitizer [compound (II-4)]) | 34.0 parts |
| Kaoline clay (50% dispersion) | 12.0 parts |

The prepared coating color is applied to one side of 50 $g/m^2$ sheet substrate, then dried up and the sheet is processed by a super calender to surface smoothness of 500–600 second. Thus, the thermal sensitive recording sheet in a coating weight of 6.0 $g/m^2$ is obtained.

EXAMPLE 19

Example 19 is an experimental result which uses compound (I-10) as a developer, ODB-2 and S205 as a dye and (II-4) as a sensitizer. Dispersion of color developer of compound (I-10), dispersion of ODB-2 and S205, and dispersion of sensitizer of compound (II-4) are treated by same procedure to Examples 1–17.

Then, the resulting dispersions are mixed together in the proportion below so as to prepare the coating color.

| | |
|---|---|
| Solution A (dispersion of developer [compound (I-10)]) | 36.0 parts |
| Solution D (dispersion of dye [ODB-2]) | 4.6 parts |
| Solution F (dispersion of dye [S205]) | 4.6 parts |
| Solution C (dispersion of sensitizer [compound (II-4)]) | 34.0 parts |
| Kaoline clay (50% dispersion) | 12.0 parts |

The prepared coating color is applied to one side of 50 $g/m^2$ sheet substrate, then dried up and the sheet is processed by a super calender to surface smoothness of 500–600 second. Thus, the thermal sensitive recording sheet in a coating weight of 6.0 $g/m^2$ is obtained.

EXAMPLE 20

Example 20 is an experimental result which uses compound (I-10) as a developer, PSD-170 and Black100 as a dye and (II-2) as a sensitizer. Dispersion of color developer of compound (I-10), dispersion of PSD-170 and Black100, and dispersion of sensitizer of compound (II-2) are treated by same procedure to Examples 1–17.

Then, the resulting dispersions are mixed together in the proportion below so as to prepare the coating color.

| | |
|---|---|
| Solution A (dispersion of developer [compound (I-10)]) | 36.0 parts |
| Solution D (dispersion of dye [PSD-170]) | 4.6 parts |
| Solution F (dispersion of dye [Black100]) | 4.6 parts |
| Solution C (dispersion of sensitizer [compound (II-2)]) | 34.0 parts |
| Kaoline clay (50% dispersion) | 12.0 parts |

The prepared coating color is applied to one side of 50 $g/m^2$ sheet substrate, then dried up and the sheet is processed by a super calender to surface smoothness of 500–600 second. Thus, the thermal sensitive recording sheet in a coating weight of 6.0 $g/m^2$ is obtained.

COMPARATIVE EXAMPLE 1

The same experiment as the Experiment 9 is carried out. But, solution E is not mixed at the preparation of color developing layer.

COMPARATIVE EXAMPLE 2

The same experiment as the Experiment 9 is carried out. But, at the preparation of solution E, p-benzyl biphenyl (PBB) is used instead of compound(II-2).

<Evaluation of Thermal Sensitive Recording Substance>

Printing tests of these thermal sensitive recording substances prepared in above mentioned Examples and Comparative Examples are carried out using TH-PMD(thermal sensitive recording paper testing apparatus, to which thermal head[Kyosera Ltd.] is installed) made by Ohkura Denki Ltd., by 0.30 mj/dot and 0.38 mj/dot impressive energy. The recording density of recorded portion is measured by Macbeth densitometer (RD-914, an amber filter is used). Test results are summed up in Table 1.

TABLE 1

| Example | developer compound | dye | sensitizer compound | record density 0.30 mj/dot | record density 0.38 mj/dot |
|---|---|---|---|---|---|
| Exp. 1 | (I-1) | ODB | (II-4) | 0.80 | 1.23 |
| Exp. 2 | (I-10) | ODB | (II-4) | 0.77 | 1.23 |
| Exp. 3 | (I-13) | ODB | (II-4) | 0.78 | 1.27 |
| Exp. 4 | (I-19) | ODB | (II-4) | 0.42 | 1.10 |
| Exp. 5 | (I-26) | ODB | (II-4) | 0.40 | 1.09 |
| Exp. 6 | (I-10) | ODB-2 | (II-4) | 0.75 | 1.25 |
| Exp. 7 | (I-10) | PSD-170 | (II-4) | 0.75 | 1.21 |
| Exp. 8 | (I-10) | CVL | (II-4) | 0.70 | 1.34 |
| Exp. 9 | (I-10) | ODB | (II-2) | 0.45 | 1.01 |
| Exp. 10 | (I-1)/(I-10) | ODB | (II-4) | 0.81 | 1.24 |
| Exp. 11 | (I-10) | ODB/ PSD-170 | (II-4) | 0.80 | 1.25 |
| Exp. 12 | (I-10) | ODB | (II-2)/(II-4) | 0.76 | 1.17 |
| Exp. 13 | (I-1) | S205 | (II-2) | 0.83 | 1.24 |
| Exp. 14 | (I-10) | S205 | (II-4) | 0.79 | 1.25 |
| Exp. 15 | (I-19) | S205 | (II-4) | 0.46 | 1.13 |
| Exp. 16 | (I-1) | Black100 | (II-4) | 0.79 | 1.23 |
| Exp. 17 | (I-10) | Black100 | (II-4) | 0.77 | 1.24 |
| Exp. 18 | (I-10) | ODB/S205 | (II-4) | 0.78 | 1.24 |
| Exp. 19 | (I-10) | ODB-2/S205 | (II-4) | 0.79 | 1.25 |
| Exp. 20 | (I-10) | PSD-170/ Black100 | (II-2) | 0.52 | 1.15 |
| Com.Ex.1 | (I-10) | ODB | — | 0.05 | 0.20 |
| Com.Ex.2 | (I-10) | ODB | PBB | 0.08 | 0.28 |

It is clearly understood from Table 1 that the results from Examples 1 to 20 of the present invention which use the developer indicated by general formula (I) and the sensitizer indicated by general formula (II) show the remarkable improvement for a sensitizing effect. On the other hand, from the results of Comparative Example 1 not using the sensitizer indicated by general formula (II) and the Comparative Example 2 using p-benzylbiphenyl which is known to have an excellent sensitizing effect to the conventional well-known developer bisphenol A, it is obvious that the effect for sensitizing is inferior and the recording density is low.

EFFECT OF THE INVENTION

According to the present invention, the following excellent effect is performed. That is, when the derivatives of amino benzene sulfone amide indicated by said general formula (I) are used as a developer, the thermo sensitive recording substance which has high sensitivity for color developing and clear recording image can be obtained by including the compound of sulfone amide indicated by said general formula (II) as a sensitizer.

What is claimed:

1. A thermally sensitive recording sheet comprising a substrate having thereon a thermally sensitive color developing layer mainly composed of a colorless or pale colored basic leuco dye and an organic color developer, characterized by said thermally sensitive developing layer including:

as an organic color developer, derivatives of amino benzene sulfone amide indicated by the following general formula (I)

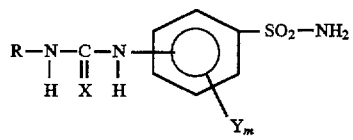

(I)

wherein

X is an oxygen or sulfur atom,

Y is an alkyl group of 1–4 carbon atoms or an electron attracting group, m is an integer of 0 to 4, and R is a non-substituted or a substituted phenyl group, an aralkyl group, an alkyl group of 1–6 carbon atoms, a cycloalkyl group of 3–6 carbon atoms, an alkenyl group of 2–6 carbon atoms or a naphthyl group; and as a sensitizer, in an amount of 0.01–2 parts based on 1 part of the color developer indicated by the general formula (I), a sulfone amide compound indicated by the following general formula (II)

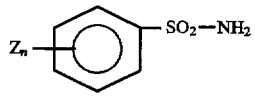

(II)

wherein

Z is an alkyl group of 1–6 carbon atoms or an electron attracting group, and n is an integer of 0 to 2.

* * * * *